US005381966A

United States Patent [19]

Gernert, II

[11] Patent Number: 5,381,966

[45] Date of Patent: Jan. 17, 1995

[54] FUEL INJECTOR

[75] Inventor: George G. Gernert, II, Taylors, S.C.

[73] Assignee: Lucas Industries Public Limited Company, Solihull, England

[21] Appl. No.: 103,773

[22] Filed: Aug. 10, 1993

[30] Foreign Application Priority Data

Aug. 14, 1992 [GB] United Kingdom ..... 9217281

[51] Int. Cl.[6] ..... F02M 51/06

[52] U.S. Cl. ..... 239/585.3; 239/585.1; 251/129.16

[58] Field of Search ..... 239/585.1, 585.3; 251/129.16; 267/170, 179

[56] References Cited

U.S. PATENT DOCUMENTS

| | | | |
|---|---|---|---|
| 4,572,436 | 2/1986 | Stettner et al. | 239/585 |
| 4,655,396 | 4/1987 | Taxon et al. | 251/129.16 |
| 4,807,812 | 2/1989 | Renowden et al. | 239/585.3 |
| 4,909,447 | 3/1990 | Gallup et al. | 251/129.16 |
| 4,917,307 | 4/1990 | Baxter et al. | 239/585.3 |
| 4,925,112 | 5/1990 | Wahba | 239/585.3 |
| 4,932,593 | 6/1990 | Kiracofe et al. | 239/585.3 |
| 5,080,288 | 1/1992 | Shen | 251/129.16 |
| 5,163,623 | 11/1992 | Seino | 239/585.3 |
| 5,246,215 | 9/1993 | Takamura et al. | 267/179 |

FOREIGN PATENT DOCUMENTS

| | | | |
|---|---|---|---|
| 0026060 | 4/1981 | European Pat. Off. . | |
| 0328277 | 8/1989 | European Pat. Off. . | |
| 2147949 | 5/1985 | United Kingdom | 239/585.3 |

*Primary Examiner*—Andres Kashnikow
*Assistant Examiner*—Christopher G. Trainor
*Attorney, Agent, or Firm*—Jacobson, Price, Holman & Stern

[57] ABSTRACT

A fuel injector has a circular plate like valve member (31) urged into engagement with an annular seating element (29) formed on the face of a seat member (23) in a closed position. A discharge orifice (28) is formed in the seat member through which fuel can flow when the valve member is lifted from the seating element (29) into an open position by magnetic forces produced by energizing a solenoid winding (17). The valve member is located within an annular spacer member (22) and a recess is formed in the face of the valve member remote from the seating element in which is located one end of a coiled compression spring (33). The base wall (35) of the recess is inclined at an angle between 6° and 16° with respect to the opposite surface of the valve member engageable with the seating element and is engaged by the spring so that a lateral force is applied to the valve member to urge it into engagement with the inner wall of the spacer member. The inclined surface may be provided on an insert (36) in the recess.

20 Claims, 2 Drawing Sheets

FUEL INJECTOR

BACKGROUND OF THE INVENTION

This invention relates to a fuel injector for supplying liquid fuel to an air inlet duct of a spark ignition engine and of the kind comprising a valve seat member in which is formed a discharge orifice and about which on one side of the seat member is formed an annular seating element, a circular plate-like valve member which is urged into engagement with said seating element by means of a spring to prevent flow of fuel through said discharge orifice, an electromagnet which when energized attracts the valve member away from the seating element to allow fuel flow through the orifice and an annular spacer member which surrounds the valve member.

An example of such a fuel injector is seen in European Patent Application Publication No. EP-A-0328277 wherein spring is of the coiled compression type and is located within a bore formed in a central core member of the electromagnet. The bore also serves to convey fuel from an inlet of the injector to adjacent the valve member so that when the latter is lifted from the seating element, fuel can flow through the outlet orifice. The end of the spring adjacent the valve member is located within a recess formed in the adjacent face of the valve member. The base wall of the recess in a practical example of the injector is made parallel to the surface of the valve member which engages the seating element and the rim of the valve member is rounded. A small clearance exists between the rim and the internal surface of the spacer member.

In the use of the injectors it is found that the performance of some injectors is not consistent with the flow of fuel through the injector for a given fuel pressure at the inlet and for a given length of energizing pulse, varying throughout the life of the injector. The variation of fuel delivery is undesirable.

BRIEF SUMMARY OF THE INVENTION

The object of the present invention is to provide an injector of the type specified above, but having a more consistent performance than heretofor knows.

According to the invention in a fuel injector of the type specified the face of the valve member remote from the seating element is provided with a centrally disposed recess and the base wall of the recess or the corresponding wall of an insert located within the recess, and which is engaged by the end of the spring, is inclined to the surface of the valve member which is presented to the seating element, the inclination of the wall resulting in a lateral force being applied to the valve member so as to urge the rim of the valve member into engagement with the internal surface of the spacer member.

BRIEF DESCRIPTION OF THE DRAWINGS

An example of an injector in accordance with the invention will now be described with reference to the accompanying drawings wherein.

Figure 1:
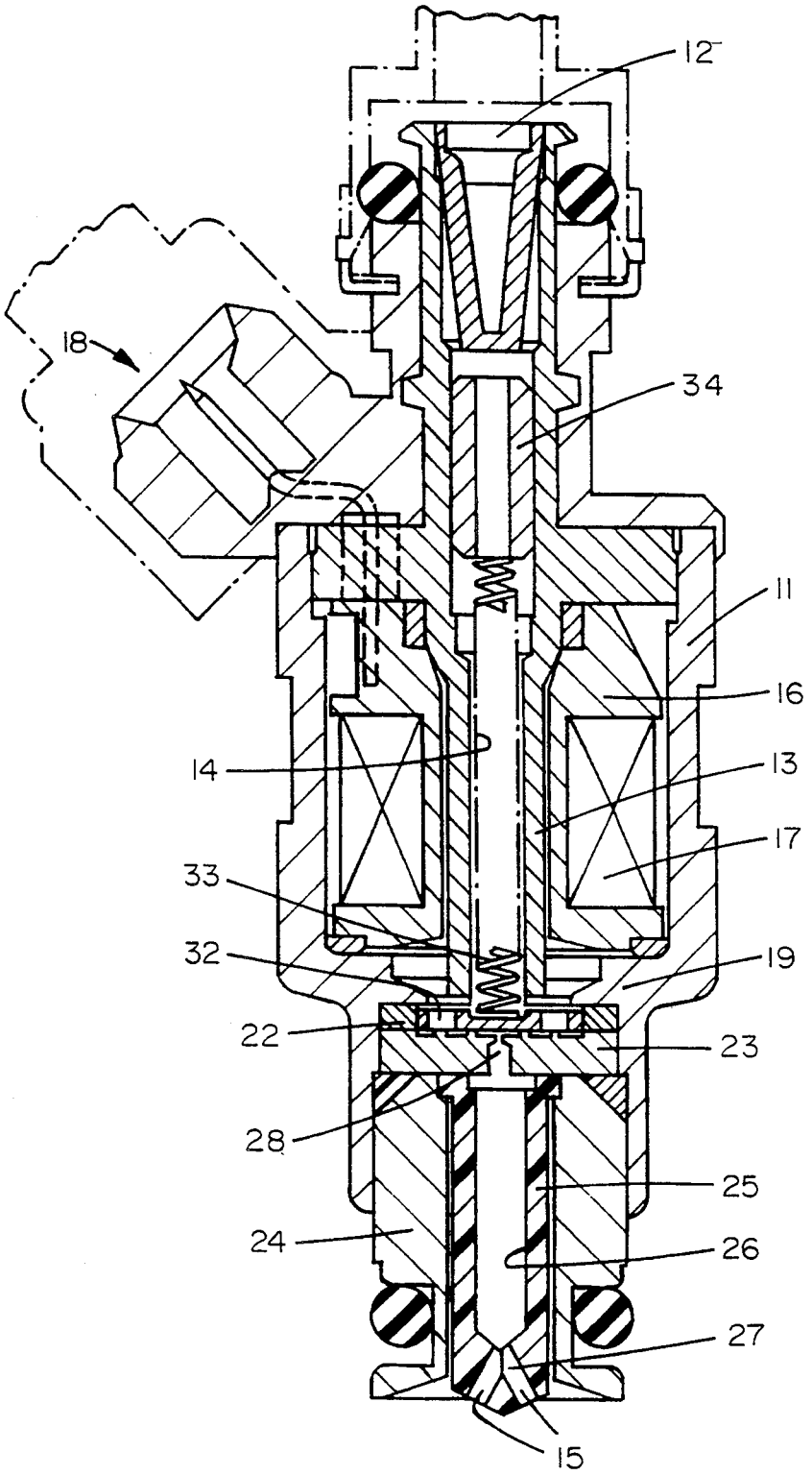
FIG. 1 is an axial cross sectional view of the injector.

Referring to the drawings the injector comprises a hollow generally cylindrical outer body 11 formed from magnetic material. Within the body there extends a magnetic hollow flanged core member 13 through which extends a passage 14 which at the flanged end of the core member is connected to an inlet 12. Surrounding the core member 13 within the body is a former 16 which is formed from synthetic resin material and upon which is wound a solenoid winding 17 the ends of which are connected to terminals in a connector member 18.

The body 11 defines an inwardly extending annular shoulder 19 the face 20 of which remote from the solenoid defines a pole face against which is located a non-magnetic annular washer 21. The washer may be formed from stainless steel. Adjacent the washer there is located an annular non-magnetic spacer member 22 which is engaged by a seat member 23. The seat member is held in position by means of an annular generally tubular outlet member 24 which is secured within the outer body 11. In the example there is located within the outlet member an insert 25 which is provided with a central drilling 26 and an end wall which defines a pair of inclined through holes 27 which terminate in outlets 15.

Formed in the seating member is a central discharge orifice 28 and surrounding the orifice 28 and formed on the face of the seating member presented to the core member 13, is an annular seating element 29. A further annular element 30 is provided on the face of the seating member, the further element 30 surrounding and being spaced outwardly of the seating element 29.

Moveable in the space which is defined between the core member and the seating member is a circular plate-like valve member 31 which is formed from magnetic material. The diameter of the valve member is slightly smaller than that of the circular aperture in the spacer member. The rim of the valve member is rounded and formed in the valve member are a series of angularly spaced openings 32 which are positioned outwardly of the seating element 29. The face of the valve member remote from the core member is carefully machined so as to form a seal with the seating element 29 in the closed position of the valve member.

The valve member is biassed into engagement with the seating element 29 by means of a coiled compression spring 33 which is located in the bore 14. One end of the spring engages a sleeve-like element 34 which is an interference fit in the bore and the other end of the spring is located within a recess 35 which is formed in the face of the valve member 31 presented to the core member 13.

In use, the outlet member 24 is located in the wall of an air inlet duct of a spark ignition engine with the outlets 15 positioned to direct fuel into the individual air inlets of a pair of adjacent engine cylinders or into a pair of air inlets of a single cylinder. When the solenoid winding 17 is energized the central core member 13 and the flange 19 are polarized to opposite magnetic polarity and the valve member is lifted away from the seating element to allow fuel to flow through the orifice 28. The extent of movement of the valve member is limited by its engagement with the washer 21 and the thickness of this washer is so arranged that there is no contact between the core member and the valve member. In the example the fuel which flows through the orifice 28 is directed at the bridge defined between the inner ends of the drillings 27 and fuel sprays issue from the outlets 15 to mix with the air flowing to the combustion chambers. When the solenoid is de-energized the valve member moves under the action of the spring 33 to reestablish seating engagement with the seating element 29 so that fuel flow through the orifice 28 is prevented. Owing to the slight difference in the diameter of the valve member 31 and the aperture in the spacer member 22 a small gap exists therebetween and the rim of the valve member is curved so that there is minimum interference to the movement of the valve member when the solenoid is energized. In the past the base wall of the recess 35 has been made parallel to the surface of the valve member which engages the seating element 29. It has been found however that over the life of the injector the quantity of fuel which flows through the injector for a given length of energizing pulse and a given fuel pressure at the inlet, tends to increase. It has been found however that by inclining the base wall of the recess 35 relative to the surface of the valve member which engages the seating element 29, the aforesaid effect can be minimized.

Figure 2:
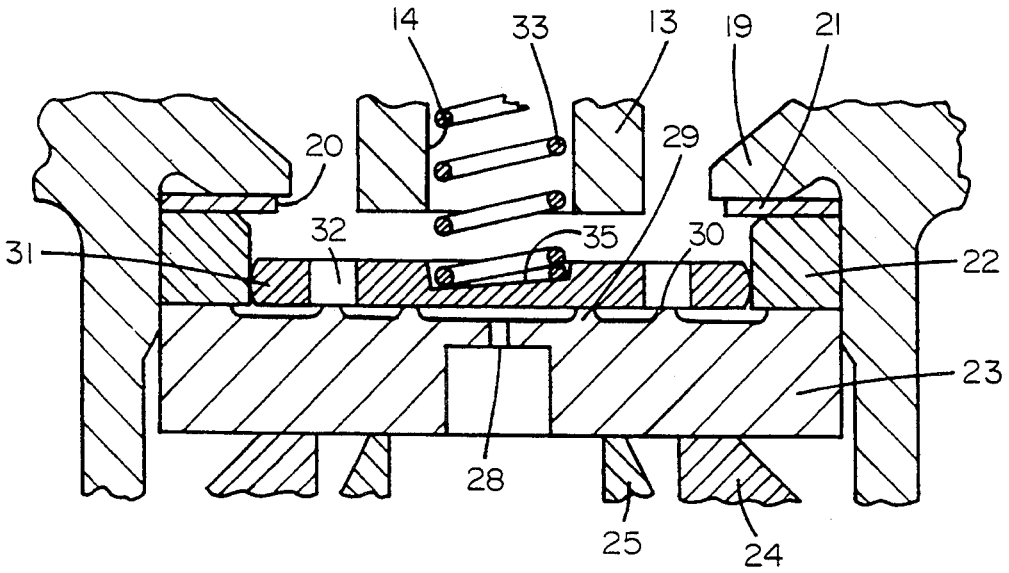
FIG. 2 is a view an an enlarged scale of part of the injector seen in FIG. 1.
Figure 3:
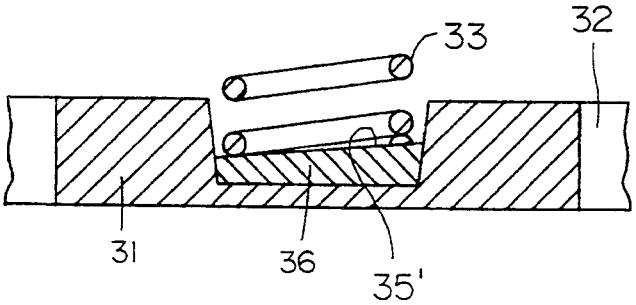
FIG. 3 is an enlarged cross-sectional view of part of the injector as seen in FIG. 2 showing a different embodiment of the valve member.

The range of inclination of the base wall of the recess can lie between 6° and 16°. The effect of inclining the base wall of the recess is to cause the spring 33 to exert a side thrust on the valve member 31 so that at one point the rim of the valve member engages with the spacer member 22. Excessive side thrust has to be avoided and above the upper limit of inclination quoted there is a tendency for the valve member as it moves away from the seating element under the influence of the magnetic field, to lift in a series of jerks so that variation in the dynamic fuel flow can occur. With an inclination below the minimum quoted, there is no worthwhile improvement. The optimum value appears to be 12° of inclination. As illustrated in FIG. 2, the base wall of the recess is inclined. However, there can be located between the spring and the base wall of the recess a wedge like insert 36, as shown in FIG. 3, having inclined surface 35' thereon to provide the required effective inclination. In the example the valve member has a diameter which lies between 8.95 mm and 8.925 mm and the internal diameter of the spacer member 22 lies between 9.0 mm and 8.975 mm. The thickness of the spacer member 22 is adjusted so that the movement of the valve member away from the seating element is between 35 and 75 microns depending on the fuel flow required.

I claim:

1. A fuel injector for supplying liquid fuel to an air inlet duct of a spark ignition engine comprising:

a valve seat member having a discharge orifice therethrough;

an annular seating element on said valve seat member;

a circular plate-like valve member having a first face engageable with said annular seating element, a second face, a centrally disposed recess in said second face, a base wall in said recess, and a radially outer rim;

an annular spacer member surrounding said valve member and having an internal surface slidably engageable with said rim of said valve member;

spring means engaging said base wall of said recess for resiliently urging said first face of said valve member into sealing engagement with said annular seating element to prevent flow of fuel through said discharge orifice in a closed position;

electromagnetic means for attracting when energized said valve member away from said annular seating element against the force of said spring means to facilitate fuel flow through said orifice in an open position; and said base wall of said recess being inclined with respect to said first face of said valve member so that said inclination produces a lateral force applied to said valve member by said spring means for urging said rim of said valve member into engagement with said internal surface of said spacer member.

2. The fuel injector as claimed in claim 1 wherein:

said spring means comprises a coil compressor spring.

3. The fuel injector as claimed in claim 1 wherein:

said rim of said valve member is rounded.

4. The fuel injector as claimed in claim 2 wherein:

said rim of said valve member is rounded.

5. The fuel injector as claimed in claim 1 wherein:

said valve member contains magnetic material.

6. A fuel injector for supplying liquid fuel to an air inlet duct of a spark ignition engine comprising:

a valve seat member having a discharge orifice therethrough;

an annular seating element on said valve seat member;

a circular plate-like valve member having a first face engageable with said annular seating element, a second face, a centrally disposed recess in said second face, and a radially outer rim;

an annular spacer member surrounding said valve member and having an internal surface slidably engageable with said rim of said valve member;

an insert member within said recess;

an inclined face on said insert member;

spring means engaging said inclined face on said insert member for resiliently urging said first face of said valve member into sealing engagement with said annular seating element to prevent flow of fuel through said discharge orifice in a closed position;

electromagnetic means for attracting when energized said valve member away from said annular seating element against the force of said spring means to facilitate fuel flow through said orifice in an open position; and said inclined face of said insert member being inclined with respect to said first face of said valve member so that said inclination produces a lateral force applied to said valve member by said spring means for urging said rim of said valve member into engagement with said internal surface of said spacer member.

7. The fuel injector as claimed in claim 6 wherein:

said spring means comprises a coil compressor spring.

8. The fuel injector as claimed in claim 6 wherein:

said rim of said valve member is rounded.

9. The fuel injector as claimed in claim 7 wherein:

said rim of said valve member is rounded.

10. The fuel injector as claimed in claim 6 wherein:

said valve member contains magnetic material.

11. A fuel injector for supplying liquid fuel to an air inlet duct of a spark ignition engine comprising:

a valve seat member having a discharge orifice therethrough;

an annular seating element on said valve seat member;

a circular plate-like valve member having a first face engageable with said annular seating element, a second face, a centrally disposed recess in said second face, a base wall in said recess, and a radially outer rim;

an annular spacer member surrounding said valve member and having an internal surface slidably engageable with said rim of said valve member;

spring means engaging said base wall of said recess for resiliently urging said first face of said valve member into sealing engagement with said annular seating element to prevent flow of fuel through said discharge orifice in a closed position;

electromagnetic means for attracting when energized said valve member away from said annular seating element against the force of said spring means to facilitate fuel flow through said orifice in an open position;

said base wall of said recess being inclined at an angle between 6° and 16° with respect to said first face of said valve member so that said inclination produces a lateral force applied to said valve member by said spring means for urging said rim of said valve member into engagement with said internal surface of said spacer member

12. The fuel injector as claimed in claim 11 wherein: said spring means comprises a coil compressor spring.

13. The fuel injector as claimed in claim 11 wherein: said rim of said valve member is rounded.

14. The fuel injector as claimed in claim 12 wherein: said rim of said valve member is rounded.

15. The fuel injector as claimed in claim 11 wherein: said valve member contains magnetic material.

16. A fuel injector for supplying liquid fuel to an air inlet duct of a spark ignition engine comprising:

a valve seat member having a discharge orifice therethrough;

an annular seating element on said valve seat member;

a circular plate-like valve member having a first face engageable with said annular seating element, a second face, a centrally disposed recess in said second face, and a radially outer rim;

an annular spacer member surrounding said valve member and having an internal surface slidably engageable with said rim of said valve member;

an insert member within said recess;

an inclined face on said insert member;

spring means engaging said inclined face on said insert member for resiliently urging said first face of said valve member into sealing engagement with said annular seating element to prevent flow of fuel through said discharge orifice in a closed position;

electromagnetic means for attracting when energized said valve member away from said annular seating element against the force of said spring means to facilitate fuel flow through said orifice in an open position; and said inclined face of said insert member being inclined at an angle between 6° and 16° with respect to said first face of said valve member so that said inclination produces a lateral force applied to said valve member by said spring means for urging said rim of said valve member into engagement with said internal surface of said spacer member.

17. The fuel injector as claimed in claim 16 wherein: said spring means comprises a coil compressor spring.

18. The fuel injector as claimed in claim 16 wherein: said rim of said valve member is rounded.

19. The fuel injector as claimed in claim 17 wherein: said rim of said valve member is rounded.

20. The fuel injector as claimed in claim 16 wherein: said valve member contains magnetic material.

* * * * *